United States Patent [19]

Ebner

[11] 4,067,022

[45] Jan. 3, 1978

[54] INEXPENSIVE AND RELIABLE CUSTOM PROGRAMMABLE PHOTOTYPESETTER

[75] Inventor: Peter R. Ebner, South Nashua, N.H.

[73] Assignee: Itek Corporation, Lexington, Mass.

[21] Appl. No.: 652,024

[22] Filed: Jan. 26, 1976

[51] Int. Cl.[2] ..... B41B 21/20

[52] U.S. Cl. ..... 354/7; 354/10

[58] Field of Search ..... 354/5, 7, 10, 12, 15; 355/56, 57, 58, 59

[56] References Cited

U.S. PATENT DOCUMENTS

| | | | |
|---|---|---|---|
| 746,562 | 3/1956 | Mergenthaler | 354/5 |
| 3,422,736 | 1/1969 | Moyrond et al. | 354/7 |
| 3,434,402 | 3/1969 | McCall | 354/7 |
| 3,968,501 | 7/1976 | Gilbert | 354/10 |

*Primary Examiner*—Edna M. O'Connor

*Attorney, Agent, or Firm*—Homer O. Blair; Robert L. Nathans; Gerald H. Glanzman

[57] ABSTRACT

A phototypesetter is disclosed having a stepping motor which actuates an escapement carriage coupled to an elongated carriage driving member. A projection lens carriage and a collimating lens carriage are selectively electromagnetically coupled to the elongated driving member, thereby to project images of varying character sizes through a focusing lens coupled to the escapement carriage, which sequentially projects focused character images across a photosensitive film on a line by line basis. A track select mirror is also selectively electromagnetically coupled to the elongated driving member for selectively projecting one of a plurality of tracks bearing characters of differing fonts carried by a rotatable font carrier element. A group of customized lens carriage positioning control codes and customized sizing codes, unique for each phototypesetter as a function of lens parameter variations, are stored within a size dictionary and a particular set, associated with the character size being typeset is read out of the dictionary and is employed to control the customized positioning of the lens carriages and image (film) positioning stepping motors. A novel technique is also disclosed whereby a customized group of the above-mentioned codes is rapidly and easily generated by an iterative image inspection process for each particular phototypesetter during manufacture.

62 Claims, 3 Drawing Figures

INEXPENSIVE AND RELIABLE CUSTOM PROGRAMMABLE PHOTOTYPESETTER

BACKGROUND OF THE INVENTION

The present invention relates to the field of phototypesetters.

Most phototypesetters produced over the past decades employ rotatable font carriers which bear images of characters to be phototypeset. A flash lamp, under the control of digital address circuitry, sequentially flashes selected character images upon the font carrier, to produce light images which are projected through an optical system to be focused upon a photosensitive material, such optical systems also employing means for changing the character image sizes. In the phototypesetting industry, such optical character size changing devices have employed relatively large quantities of moving parts, have been costly, and have been somewhat unreliable. While optical zoom systems have been employed, relatively tedious manual adjustments of the position of the lenses with respect to their mounting devices have been required during manufacture to compensate for lens parameter variations with respect to the theoretically correct or target values. For example, variations in focal length have been compensated for, to maintain accurate focus, by mounting the lenses in a threaded sleeve which is rotated by the operator to produce fine changes in the lens position along the optical axis. Furthermore, lenses have been mounted in oversized apertures and their positions in the $x$ and $y$ directions lying in a plane perpendicular to the optical axis ($z$ axis) have been adjusted by tapping in order to translate the lenses in the plane perpendicular to the optical axis, to reduce base line errors (vertical positioning) and side of character errors (horizontal positioning). It is thus desirable to eliminate these tedious manual manipulations upon manufacture of the phototypesetters.

It is also desirable to employ a single stepping motor for actuating the scanning or escapement carriage and at the same time to employ this motor to actuate the lens carriages which must be moved along the optical axis with changes in character size, and additionally to employ this same motor to actuate a font disc track select carriage.

It is furthermore desirable to provide a simple and reliable driving system for positioning these carriages with great accuracy and reliability and yet be inexpensive to manufacture. Furthermore, it is desirable to reduce manufacturing costs by mounting lenses into the phototypesetter having loose manufacturing tolerances, and which individual tolerance variations may be compensated for in the easy and rapid generation of digital positioning command codes which are customized for each particular machine during manufacture to eliminate the effect of such variations.

SUMMARY OF THE INVENTION

In accordance with a preferred embodiment of the present invention, a single $x$ stepping motor drives a scanning or escapement carriage along with a flat elongated driving member which in turn is electromagnetically and selectively coupled and decoupled to and from a projection lens carriage, a collimating lens carriage, and a track select carriage. The flat upper surface of the driving member co-acts with flat lower clutch surfaces of the carriages to provide a simple and reliable system for accurately positioning such carriages in incremental fashion.

A size dictionary produces, for each particular machine, sets of customized focus position control codes which position the lens carriages at particular positions along the optical axis to maintain focus regardless of lens tolerance variations. Customized sizing codes alter the theoretically correct image positions to compensate for variations in lens positioning with respect to the optical axis which effect side of character image position variations and character base line image position variations. The latter two codes are employed to modify the stepping of the $x$ and $y$ motors, thereby to produce images having correct base line placement and side of character placement for all character sizes. During manufacture, the aforementioned customized codes are generated by selecting tentative codes for initially positioning the lens carriages and film placement in $x$ and $y$ and observing focus and image placement errors. The errors are eliminated by having the operator alter the positioning codes to shift the aforementioned positioning of film and lens carriages step by step until the errors are reduced to a satisfactory level or eliminated. The finally altered customized focus and sizing codes are thereafter retained in permanent storage in the typesetter control system and are thereafter employed to effect the above-mentioned positioning functions over the life of the phototypesetter. In accordance with a further aspect of the invention, a unique coupler is employed for positively driving the elongated driving member parallel to its longitudinal axis and which prevents binding of the driving member to the clutches after de-energization of the clutches to prevent the possibility of unintentional shifting of the carriage positions along the optical axis.

Other objects, features, and advantages of the present invention will become apparent upon the perusal of the following detailed description taken in conjunction with the drawings in which.

DETAILED DESCRIPTION

Figure 1:
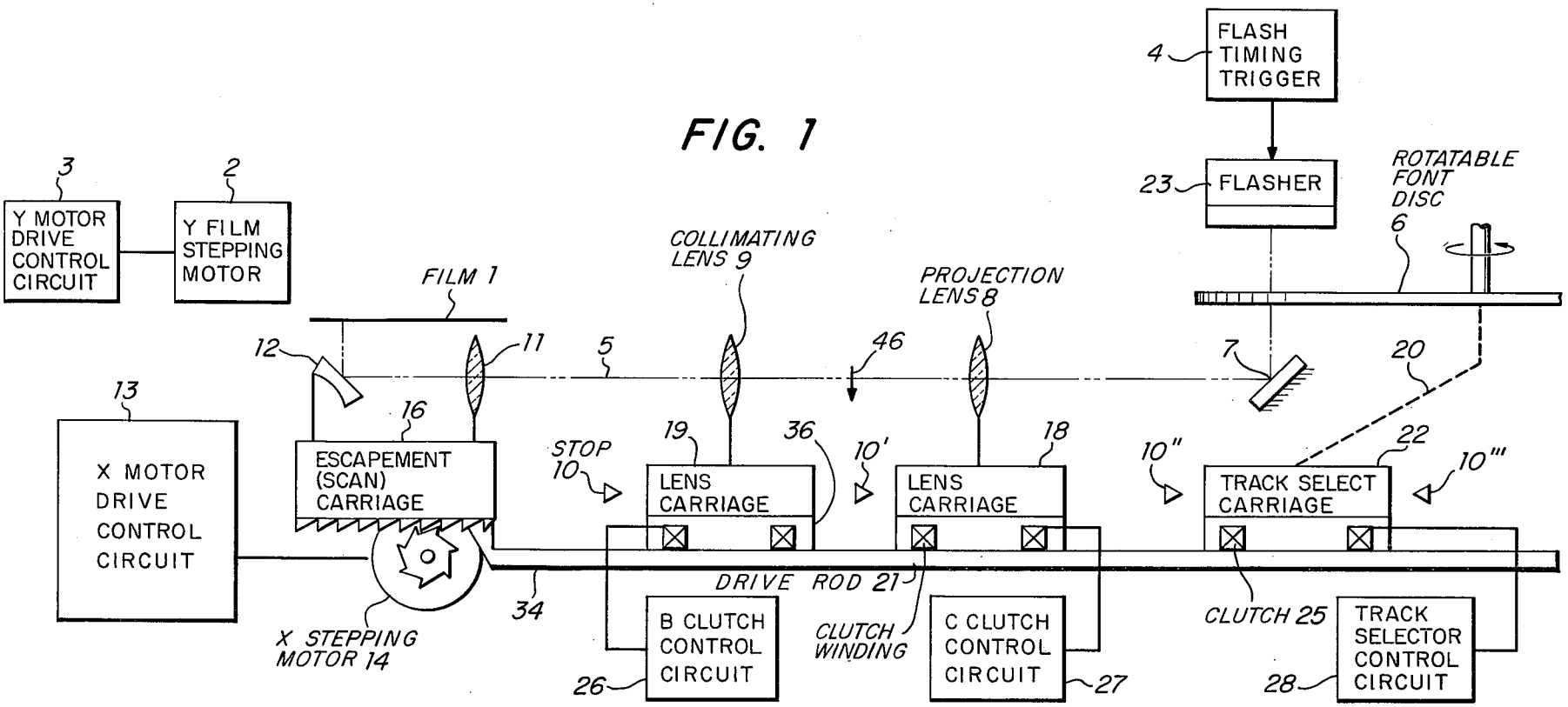
FIG. 1 illustrates the mechanical aspects of the preferred embodiment.

The photosensitive medium or film 1, which is to record the light images of the projected characters, is stepped by film feed stepping motor 2 in the Y direction, for each line to be recorded, which stepping is controlled by Y motor drive control circuit 3, illustrated in FIG. 1.

Flash timing trigger circuit 4 causes the illumination of a particular character formed upon rotatable font disc 6, which in turn produces an image which is recorded upon film 1 by means of the optical system comprising stationary mirror 7, C lens 8, B lens 9, A lens 11, and mirror 12. An X motor drive control circuit 13, controls the stepping of X motor 14, which in turn steps escapement carriage 16 to sequentially record a line of characters across film medium 1. In other words, after a particular character is flashed and recorded, the X motor 14 incrementally steps escapement carriage 16 to a displaced position in X to properly record the next adjacent character in the line being recorded.

It is an important feature of the invention to control the initial positioning of lenses 8 and 9, which positioning is a function of the image size to be recorded by means of a single X stepping motor, which also functions to step escapement carriage 16 to sequentially record letters in any particular line. This cost saving aspect of the invention is made possible by selectively coupling and decoupling lens carriages 18 and 19 to and from drive rod 21, which is mechanically coupled to escapement carriage 16. Drive rod 21 also actuates track (font) select carriage 22, which in turn positions font disc 6 in one of two positions to cause the twin concentric tracks containing separate font sets to be selectively illuminated by flasher 23. Binary codes are also read off of disc 6 to enable selective character flashing as is known in the art. Mirror 7 is stationary so that no change in the conjugate object distance occurs with changed tracks. The rotatable spindle, not shown, carrying rotatable font support means 6 is coupled to track select carriage 22 to effect the above-mentioned track selections. This coupling is schematically illustrated by dashed line 20. The B clutch control circuit 26 controls the energization of the B lens carriage clutch while the C clutch circuit 27 controls the energization of the C lens carriage clutch. Central flux generating windings are positioned about the central legs of the clutches and are represented by the X's as illustrated. Such a clutching arrangement also is employed in connection with the track select carriage 22. The clutch of carriage 22 is controlled by track selector circuit 28.

Broadly speaking, energizing the B and C clutches causes them to become tightly coupled to the drive rod, and the clutch energizing intervals are individually controlled while escapement carriage 16 drives rod 21 to selectively position lenses 8 and 9 at predetermined positions which are a function of the desired size of the character to be recorded on film 1. Also, the track select carriage 22 is driven, during energization of the carriage clutch 25, by drive rod 21 for track selection. A low cost means of generating variable size output characters is thus provided by employing a zoom system in which the lenses are positioned by a very simple inexpensive and reliable technique in contrast with the prior art approaches. A simple and reliable means of selecting a particular track of a multitrack font character also results in the above-mentioned structural arrangement. Besides the above-mentioned positioning functions, the single X motor steps the escapement carriage mounted mirror "across" the film to form a line of characters. At the end of a line, the Y film stepping motor 2 is stepped to feed the film in the Y direction a predetermined distance and the escapement carriage is reset to set the stage for recordation of a subsequent line. As will be explained in greater detail hereinafter, the X position of the escapement carriage and the Y position of the stepped film will be modified for varying size changes in the characters to be image positioned on film 1 in order to insure that the characters are projected at the proper position within each character field so that even, aesthetically correct, lines of characters are recorded, regardless of character size changes.

An important additional aspect of the invention explained below is to individually calibrate the lenses fitted into each machine, for manufacturing tolerance variations, and to modify the "size focus" and "image position" command codes in the dictionary to account for the individual variations, thereby to save in the cost of manufacturing the phototypesetters.

Figure 2:
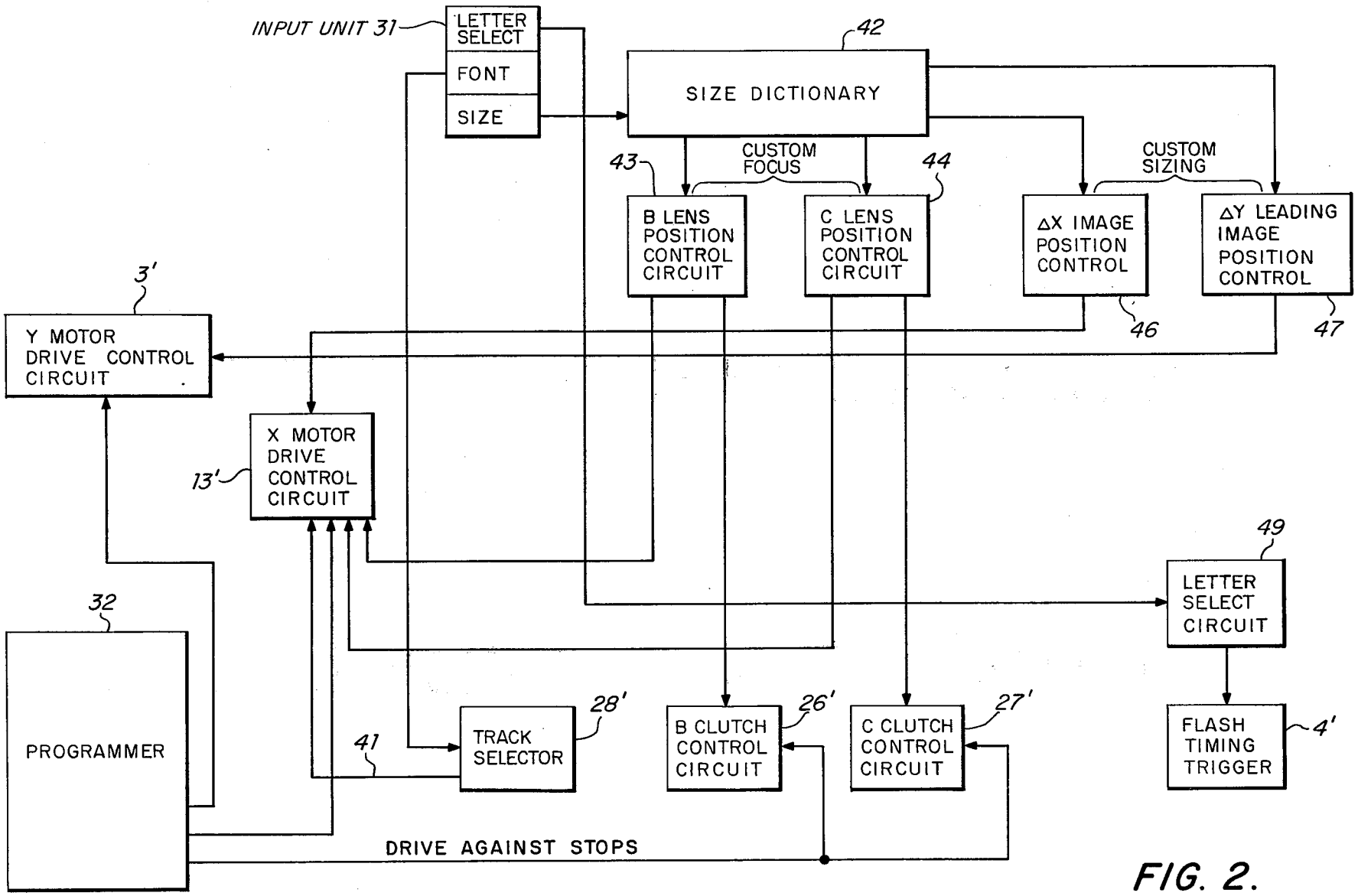
FIG. 2 illustrates the electronic and control aspects of the present invention.

FIG. 2 schemetically illustrates the various electronic control functions, which control the component actuating devices described above in the description of FIG. 1. The control circuit designations of FIG. 1 have their counterparts identified with like primed designations in FIG. 2. For example, B clutch control circuit 26 of FIG. 1 is designated as B clutch control circuit 26' of FIG. 2.

INITIAL POSITIONING OF THE CARRIAGES

The phototypesetter of the present invention is operated by virtue of a program, which is loaded into an input unit 31 illustrated at the top of FIG. 2 and which may consist of a magnetic tape which contains digital information recorded thereon which commands the phototypesetter with respect to format, characters to be generated, the particular font of the characters to be generated and their sizes.

A timing programmer is schematically represented by block 32, which contains circuitry for carrying out certain sequencing steps performed in the phototypesetter. Upon commencement of the operation, it is first desired to drive lens carriages 18 and 19 to their extreme left-hand positions against stops 10 and 10', illustrated in FIG. 1, to position them in the home position. This is effected by a command from programmer 32, which causes the X motor drive circuit 13 to step the carriage 16, and hence, drive rod 21 to the left. At the same time, clutch control circuits 26 and 27 are activated by programmer 32, so that the stepping of drive rod 21 transports carriages 18 and 19 against stops 10' and 10 respectively. Escapement carriage 16 and hence drive rod 21 is driven a substantial distance, which is larger than the maximum possible displacement of any of the carriages from their stops, to insure carriage positioning against the stops. The flux density induced in the legs of the carriage clutch E cores is of a magnitude to cause the drive rod 21 to be positively "grabbed" by the lens carriage clutches to insure transportation of them parallel to the optical axis 5. However, the flux intensity is of a magnitude which permits slippage of the drive rod 21 when the carriages are positioned against the stop elements. The drive rod 21 is rectangular in shape and has a flat machined top surface 34 slidable with respect to the flat surfaces of the ends of the clutch legs 36.

In the actual phototypesetter constructed by the inventor, four separate pie-shaped font segment carriers were employed as explained in copending U.S. Pat. application Ser. No. 619,104, filed Oct. 2, 1975, in the names of Peter R. Ebner and Louis E. Griffith assigned to the same assignee of record. However, in order to simplify the explanation of the present invention, it will be assumed that font disc 6 is a unitary disc having two tracks thereon wherein each track contains a particular font although a larger number of tracks may be provided. A font code will be transmitted from input device 31 to cause track selector 28' to energize clutch 25 of the track select carriage 22 to cause it to properly position the font disc 6 with respect to the optical axis of the device upon being actuated by drive rod 21. The code transmitted to track selector control circuit 28 in the simplest two track case, causes the track select carriage clutch 25 to be energized together with transmitting a forward or reverse signal to X motor drive circuit 13' to simultaneously step drive rod 21 to the left or right against stop 10'' or 10'''.

A dictionary 42 is addressed by a code transmitted from input unit 31 indicative of a particular desired character size (or in the absence of a desired size an automatically called for standard size) to be projected upon photosensitive film 1. The dictionary, upon being addressed by a code indicative of a particular character size, generates a B lens position code and a C lens position code which is inserted into B lens position control circuit 43 and C lens position control circuit 44 respectively. Like the remaining components schematically illustrated in FIG. 2, the size dictionary could take the form of hardware such as an array or read only memory cores, or could take the form of a magnetic tape program, as is understood by those skilled in the data processing art. In a similar manner, the information fed from input unit 31 could all be read off a magnetic tape, or some of the information could be directly encoded by a keyboard matrix.

CUSTOM FOCUS AND SIZING CARRIAGE POSITIONING

The next step is to properly position lens carriages 18 and 19 away from their above-mentioned home positions so that a sharp aerial image 46, shown in FIG. 1, is produced at the focal length of lens 9 and of the proper size for the called for character size recordation. Programmer 32 commands X motor drive circuit 13' to cause drive rod 21 to be displaced to the right while the commands from the lens position control circuit 43 and 44 to clutch control circuits 26' and 27' respectively cause the clutches of lens carriages 19 and 18 to be energized until the count in the control circuits 43 and 44 reach a value indicative of the desired position of the carriages. Since the details of circuit operations to produce these results are obvious to the worker in this art, specific explanation will not be given since numerous modes may be employed. For example, the dictionary produced codes representing the target X positions may be inserted into counters which are counted down by the pulses which indirectly step escapement carriage 16 until they reach a predetermined value such as zero, which value is detected by a logic circuit, to in turn cause de-energization of the lens carriage clutches. Each lens carriage 18 and 19 is simultaneously stepped until one is properly positioned and the other continues to be stepped until it is properly positioned.

Dictionary 42 also inserts a code into Delta X image position control circuit 46 and a Delta Y "leading" image position control code into control circuit 47. The function of these signals will be explained hereinafter.

A series of codes, each of which is indicative of a desired character to be projected along optical axis 5, is transmitted from input unit 31 to letter select circuit 49, which controls the instance of triggering of the flashing illumination source 23 for character selection. The manner in which the character selection codes cause flashing of the disc track portions for character selection as the font disc is rotated is well known to those skilled in the art in connection with so-called second generation phototypesetters. Broadly speaking the addressing letter select code is sequentially matched in rapid order aganst binary letter codes, physically associated with the characters, and read off of the disc, and when a match occurs, the lamp is flashed at a time corresponding to the instant when the selected character is at the optical axis. The escapement carriage is thereafter stepped in preparation for projection of the next character.

The alignment table stored within size dictionary 42 also produces image position modification codes having values which are a function of the character size to be set. It is well known in the art, that size changing of character images symmetrically about the optical axis is completely unsatisfactory, since the horizontal character base line, for example, would be altered with changes in the image size. Likewise with respect to the position of the side of the character field block. In other words, each character occupies an imaginary character field which can be visualized as a rectangular grid, the lower left-hand corner of which must always assume the same position regardless of changes in grid and hence character size. In accordance with this requirement, a change in character size must be accompanied by a Delta X image position control command, which modifies the X position of the escapement carriage 16; likewise with respect to a change in the image position in the Y direction, which may be thought of as a change in "leading," analogous to the insertion of horizontal lead strips having various vertical dimensions for various character sizes employed in first generation typesetters, where the letters are composed by the mechanically positioning of lead blocks. Thus, a signal is generated by Delta X image position control circuit 46, which modifies the escapement carriage X position altering the number of impulses which would otherwise be produced by X motor drive control circuit 13'. In like manner, the number of impulses produced by Y motor control circuit 3' is modified by the Delta Y leading image position code retained in control circuit 47 to alter the final film feed position in Y. Thus, the size dictionary 42 generates two codes for focusing purposes and two codes for alteration of image position to maintain uniformity of format with changes in type size.

It is an important feature of the present invention that the particular code values inserted into circuits 43, 44, 46, and 47 discussed above are a function of the particular lens parameters of each particular machine. Since these values are preferably stored in a read only memory, they will not be altered or erased over the life of the machine. Manufacturing costs are considerably reduced since particular B and C lenses are inserted into a particular machine, and the carriages are thereafter positioned at whatever positions in X which produce sharp images in each of the desired character sizes. These particular positions in X (custom focus codes) are thereafter inserted into the read only memory of size dictionary 42, which properly positions the carriages over the life of the machine at positions that generally differ somewhat from the positions which would be assumed by ideal lenses having theoretically "correct" focal lengths. In like manner, a custom calibration of the actual lenses inserted into each machine is carried out so that custom sizing code values for the Delta X image position control and the Delta Y "leading" image position control are generated and are also inserted into the read only memory for each desired character size. The latter two values for each letter size are designated as "custom sizing" values while the former two values for each letter size are designated as "custom focus" values. These customized individual sets of values associated with each letter size comprise the alignment table of dictionary 42. In summary, these values will be determined for each machine and stored in a programmable "read only" memory circuit. At the time of manufacture, this technique will permit focusing and sizing to be properly accomplished rapidly and accurately on a custom basis taking into account lens parameter variations.

If desired, a variable flash intensity code may be stored within the size dictionary 42 for each character size to maintain exposure at film 1 constant, regardless of variations in the character size. The conversion of the flash intensity codes into varying signals to produce varying flash intensities form no part of the present invention. As may be seen from perusal of U.S. patent application Ser. No. 628,692, filed Nov. 3, 1975, in the names of Peter R. Ebner and Louis E. Griffith, assigned to the same assignee of the present invention, the digital flash intensity codes may be converted into flash lamp activating charges having energies associated therewith which are a function of the value of the flash intensity codes.

The system of FIG. 1, causes lenses 8 and 9 to be positioned so that the aerial image 46, regardless of its size, is always at the focal point of lens 9. Once the positions of lenses 8 and 9 are assumed, they remain in those positions until a change is made in the character size. The above-mentioned positioning of aerial image 46 at the focal point of lens 9 means that the light rays between lens 9 and lens 11, mounted on escapement carriage 16, will be collimated light so that the final projected image will remain in focus as the carriage is stepped along in X to record a line of characters.

As a result of this mechanical organization, it should now be appreciated that a single stepping motor performs a number of positioning functions with regard to the optical elements of the system, and at the same time, is able to record a sharply imaged line of characters across the width of the recording medium. At the end of the line, the programmer actuates the Y motor control circuit 3' to advance the film in preparation of the recordation of the subsequent line of characters and resets the escapement carriage 16. When the input unit 31 instructs the phototypesetter to change character size, the carriages may be again actuated to the left against the stop elements, in the home position as described above, and storage elements associated with control circuits 43, 44, 46, and 47, retaining the custom focus values and the custom sizing values, may be cleared in preparation of the receipt of a new set of values from size dictionary 42 corresponding to the new character size, and the entire process explained above is repeated. In the alternative, a running count of these positioning values may be retained and alternated by new sizing data in accordance with techniques well known in the data processing art, thereby to eliminate the positioning of the carriages back to the initial home positions until the machine is shut down.

DRIVE ROD COUPLER

As mentioned hereinabove, the track select carriage, projection lens carriage, and collimating lens carriage are mechanically coupled and decoupled to a rectangular drive rod 21 having a smooth flat surface which slides past the flat surfaces of the E clutches when they are not energized and which are in tight face-to-face contact with the faces of the clutches when they are energized. In the interest of smooth and accurate operation with the employment of reasonable quantities of flux to effect adequate "grabbing" of the clutches, it is desirable to prevent translation in space of the drive rod to alter the degree of separation or contact forces between the drive rod and the clutch faces. In FIG. 1, the drive rod is shown rigidly coupled to the escapement carriage. In practice this is deemed undesirable since shifting of the unitary body including both the carriage and drive rod could produce undesirable shifts in the position of the lens carriages even though the clutches are deactivated. Accordingly, a special coupler has been provided to prevent the possibility of these occurrences.

Figure 3:
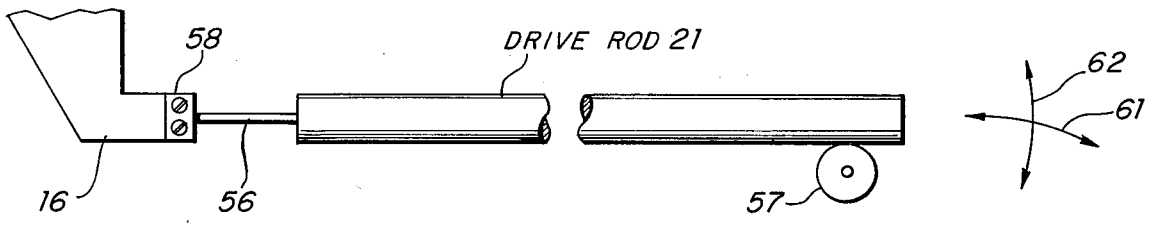
FIG. 3 illustrates the key element in the coupling member for linking the flat drive member to the escapement carriage.

In FIG. 3, a segment of a piano wire 56 is rigidly coupled between drive rod 21 and a terminal portion of escapement carriage 16. Drive rod 21 is supported by at least one rotatable wheel 57. The piano wire may be detachably coupled to carriage 16 by means of a clamp such as 58. Ordinary piano wire having a free length of 1 inch and having a diameter pf 1/16 inch has been employed and provides positive driving of drive rod 21 when in both tension in the pulling mode and compression in the pushing mode. At the same time, the drive rod has two degrees of freedom perpendicular to its longitudinal axis, which degrees of freedom are represented by arrows 61 and 62. As a result of this arrangement, inadvertent lens position shifts do not occur during deenergization of the clutches.

CUSTOMIZED POSITIONING CODE ALTERATIONS DURING MANUFACTURE FOR EACH INDIVIDUAL PHOTOTYPESETTER

Lens positioning adjustments in accordance with prior art approaches, employ devices and techniques for making minute changes on the spatial positioning of the lenses with respect to the optical axis manually. For example, adjustments of the lenses along the optical axis in the $z$ direction have been manually accomplished by turning a finely threaded screw associated with a lens mount sleeve, which in turn produces minute changes in the lens position in $z$ to obtain sharp focus for individual lenses having varying focal lengths due to manufacturing tolerances. The manual adjustment of such threaded member is eliminated in accordance with the present invention, since the lens carriages are initially positioned at the theoretically correct position along the optical axis by initial position command codes stored within the carriage position command control system which produce such initial carriage positions. The sharpness of the image is inspected by an operator under a microscope and the initial position code is slightly altered in value by an incremental change code keyboarded into the control command input tape of the carriage position command control system by the operator and the carriage position is accordingly slightly changed. The image is reinspected, and the process is repeated until a sharp character is produced. The altered initial theoretically correct position code now becomes the final positioning command code, which has a customized code value for the particular machine have the particular "loose tolerance" lens therein. As discussed hereinabove, customized sizing codes are generated for each particular machine, one of which is the delta $x$ position control code for altering the theoretical escapement carriage position and thus relative image position in the $x$ direction and the other is the delta $y$ leading image position code which alters the intial theoretically correct $y$ positioning of the film feed and thus the relative image positioning in $y$. One typical prior art approach, in order to eliminate base line ($y$) errors and side of character positioning ($x$) errors, which are corrected by the delta $y$ and delta $x$ codes respectively, involves mounting the lenses within oversize apertures and tapping the lenses in $x$ and $y$ directions perpendicular to the optical axis, thereby to translate the lens in space in a plane perpendicular to the optical axis until the above-mentioned base line errors and side of character errors of the projected image of various character sizes are substantially eliminated. With the above-described techniques involving slight alterations of custom sizing codes for altering the positioning of the $x$ and $y$ motors, these tedious manual manipulatons are eliminated. The procedure is similar to the trial and error focusing technique described above in connection with inspection of the characters under the microscope. More specifically, a print-out on the developed film is inspected and the base line errors for each character size are determined by visual inspection.

An incremental code change is keyboarded into the command tape program and the theoretically correct $y$ position code is slightly altered, which sends a signal to the $y$ motor drive control circuit to step the $y$ motor a particular increment and the process is repeated to correct the final base line position. In like manner, variations in the positions of the sides of the characters for the various character sizes are eliminated by altering the theoretically correct $x$ position code so that the final position of the escapement carriage is altered. This procedure is repeated for each character size. Thus, these highly flexible steps may be carried out by an unskilled operator, in contrast to the above-mentioned manual techniques by relatively skilled personnel, thereby to effect considerable savings in the cost of manufacture of the typesetters. Also, loose lens tolerances reduce manufacturing costs and very accurate results are attained since each machine increment is defined by a single step of the $x$ and $y$ stepping motors of only 0.002 inch.

In the interest of clarity, brevity and economy, the electronic control circuits schematically set forth above have not been described in detail since such detail forms no part of the invention, and since they are within the skill of the worker in this relatively advanced and mature art.

However, reference may be made to U.S. Pat. Nos. 3,485,150, and 3,339,470 issued Sept. 5, 1976 and patents cited therein, for circuit details of a number of sub-systems which could be utilized in the practise of the system of the present invention.

FIG. 15 of the U.S. Pat. No. 3,339,470 illustrates an overall schematic of a digitally controlled electronic phototypesetter. Broadly speaking, character selection occurs by sequentially reading character identification binary codes off of the font disc and comparing such codes with a character address code representing the particular character to be flashed. Upon positive comparison, a signal is generated to flash the character and project an image thereof along the optical axis, the character address coming from a tape reader through decoder 555 and through character selector 640. See columns 25+ of the U.S. Pat. No. 3,339,470 patent for details. In this regard reference may also be made through the following U.S. Pat. Nos. 2,944,472, 3,059,219, and 2,846,932. X stepping motor 755 of the U.S. Pat. No. 3,339,470 patent causes character spacing by stepping of the photo sensitive medium in the X direction, under the command of a string of pulses which are developed by space computer 725, explained in column 28+ of the U.S. Pat. No. 3,339,470 patent. A particular desired point size is fed into encoder 727 while the character width code of a particular character to be recorded is applied to space computer 725 by pick up unit 720. The space computer thereafter computes the necessary displacement of the photo sensitive media in X as a product of the character width code and the point size code and applies a string of pulses to space control circuit 752 as explained in detail in columns 28–33 of the U.S. Pat. No. 3,339,470. Reference may additionally be made to U.S. Pat. No. 3,141,395 for circuit details of space computer 725. Detils of the space control circuit 752, and of the similar leading (Y direction) control circuit 1040, may additionally be found in U.S. Pat. 3,183,806. Circuit details for driving the stepping motors selectively in the "forward" and "reverse" directions are set forth in column 32 of the U.S. Pat. No. 3,339,470. In addition to the aforesaid patents, circuit details suitable for automatically producing strings of pulses to position lens carriages, along the optical axis and film media in X and Y may be found in U.S. Pat. No. 3,434,402 which discloses digital feedback - closed loop arrangements for phototypesetters. See also U.S. Pat. No. 3,968,501.

While preferred embodiments and methods of the invention have been specifically described, the teachings of the invention will readily suggest many other embodiments to those skilled in the art. The scope of the invention therefore is only to be limited as indicated by the following claims.

What is claimed is:

1. In a phototypesetter:

a. a character generator for producing images of illuminated characters to be projected along an optical axis upon a photosensitive medium;

b. an $x$ positioning motor;

c. a first carrige coupled to said $x$ positioning motor, for producing relative motion between said medium and said optical axis for sequentially positioning images of said characters to be typeset across said medium;

d. an elongated drive member coupled to said first carriage;

e. a second carrige having a first lens means coupled thereto for producing a first image of said characters;

f. a third carriage having a second lens means coupled thereto for relaying the image produced by said first lens means for subsequent projection upon said imaging medium;

g. second carriage clutch means associated with said second carriage for coupling and decoupling said second carriage to and from said elongated driving member;

h. third carriage clutch means associated with said third carriage for coupling and decoupling said third carriage to and from said elongated driving member;

i. $x$ positioning motor drive control means for causing said positioning motor to drive said first carriage together with said elongated driving member;

j. second carriage positioning control means for actuating said second carriage clutch for selectively coupling said second carriage to said elongated driving member and for causing said $x$ motor drive control circuit to actuate said $x$ motor to position said second carriage at a position along said optical axis to produce an image of a selected size; and k. third carriage positioning control means for actuating said third carriage clutch for selectively coupling said third carriage to said elongated driving member and for causing said $x$ motor drive control circuit to actuate said positioning motor to position said second lens with respect to said first lens to focus said image upon said photosensitive medium.

2. the combination as set forth in claim 1 wherein said motor is a pulse responsive stepping motor and said motor drive control means generates pulses for actuating said stepping motor.

3. The combination as set forth in claim 1 further including:

a. a size dictionary for producing sets of positioning control codes associated with each character size which may be phototypeset, each set having a value for maintaining sharp focus for a particular character image; and b. means for inserting a first lens means position control code of a particular set into a first control circuit within said first lens position control means and for inserting a second lens position control code of said particular set into a second control circuit within said second lens position control means, for selectively controlling the positioning of said first and second lenses along said optical axis.

4. The combination as set forth in claim 3 wherein said motor is a pulse responsive stepping motor and said motor drive control means generates pulses for actuating said stepping motor.

5. The combination as set forth in claim 3 further including:

a. a $y$ motor drive circuit for actuating a $y$ film feed motor and wherein said size dictionary additionally produces a delta $x$ image position control code together with a delta $y$ leading image position control code for each set of the above-mentioned codes;

b. a delta $x$ image position control circuit responsive to said delta $x$ image position control code for commanding said $x$ motor drive circuit to modify the degree of the movement between characters to maintain proper custom sizing in $x$; and c. a delta $y$ image position control circuit responsive to said delta $y$ leading image position control code for commanding said $y$ motor drive circuit to modify the degree of film feed movement between lines of characters typeset to maintain proper custom sizing in $y$.

6. The combination as set forth in claim 1 further including:

a. a size dictionary for producing sets of position control codes associated with each character size which may be phototypeset, each set having a value for maintaining sharp focus for a particular character image size;

b. means for inserting a first lens means position control code of a particular set into a first control circuit within said first lens position control means and for inserting a second lens position control code of said particular set into a second control circuit within said second lens position control means;

c. first count alteration means within said first lens position control means for altering the count within said first control circuit during actuation of both said first lens carriage clutch means and said $x$ motor drive control circuit until said count within said first control circuit reaches a predetermined value; and d. second count alteration means within said second lens position control means for altering the count within said second control circuit during actuation of both said second lens carriage clutch means and said $x$ motor drive control circuit until said count within said second control circit reaches a predetermined value.

7. The combination as set forth in claim 6 further including:

a. a $y$ motor drive circuit for actuating a $y$ film feed motor and wherein said size dictionary additionally produces a delta $x$ image position control code together with a delta $y$ leading image position control code for each set of the above-mentioned codes;

b. a delta $x$ image position circuit responsive to said delta $x$ image position control code for commanding said $x$ motor drive circuit to modify the degree of the movement between characters to maintain proper custom sizing in $x$; and c. a delta $y$ image position control circuit responsive to said delta $y$ leading image position control code for commanding said $y$ motor drive circuit to modify the degree of film feed movement between lines of characters typeset to maintain proper custom sizing in $y$.

8. In a phototypesetter:

a. a character generator for producing images of illuminated characters to be projected along an optical axis;

b. an $x$ positioning stepping motor;

c. a first carrige coupled to said $x$ positioning motor, said first carriage having an imaging lens coupled thereto for focusing aerial images of said characters to be typeset at an imaging plane within an imaging station;

d. an elongated driving member coupled to said first carriage;

e. a projection lenscarrige having a projection lens coupled thereto for producing an aerial image of said character images;

f. a collimating lens carriage having a collimating lens coupled thereto for converting said aerial image into collimated light directed at said imaging lens coupled to said first carriage;

g. projection lens carriage clutch means associated with said projection lens carriage for coupling and decoupling said projection lens carrige to and from said elongated driving member;

h. collimating lens carriage clutch means associated with said collimating lens carriage for coupling and decoupling said collimating lens carriage to and from said elongated driving member;

i. $x$ positioning motor drive control means for transmitting electrical pulses to said $x$ position stepping motor for causing said stepping motor to incrementally drive said first carriage and said elongated driving member;

j. projection lens positioning control means for actuating said projection lens carriage clutch means for mechanically coupling said projection lens carriage to said elongated driving member and for causing said $x$ motor drive control circuit to incrementally step said stepping motor to accurately position said projection lens carriage at a position along said optical axis to produce an aerial image of a selected size; and k. collimating lens positioning control means for actuating said collimating lens carriage clutch for coupling said collimating lens carriage to said elongated driving member and for causing said $x$ motor drive control circuit to incrementally step said $x$ position stepping motor to position said collimating lens at a distance from said aerial image to collimate said aerial image so that said aerial image is focused at the imaging plane of said imaging station by said imaging lens regardless of the varying distances between said collimating leans and said imaging lens.

9. The combination as set forth in claim 8 further including:

a. a size dictionary for producing sets of projection lens position control codes and collimating lens position control codes associated with each character size which may be photoypeset, each set having a value for maintaining sharp focus for a particular character image size;

b. means for inserting a projection lens position control code of a particular set into a first control circuit within said projection lens positioning control means and for inserting a collimating lens position control code of said particular set into a second control circuit within said collimating lens positioning control means;

c. first count alteration means within said projection lens positioning control means for altering the count within said first control circuit during actuation of both said projection lens carriage clutch means and said $x$ motor drive cntrol circuit until said count within said first control circuit reaches a predetermined value; and d. a second count alteration means within said collimating lens positioning control means for altering the count within said second control circuit during actuation of both said collimating lens carriage clutch means and said $x$ motor drive control circuit until said count within said second control circuit reaches a predetermined value.

10. The combination as set forth in claim 9 further including:

a. a $y$ motor drive circuit for actuating a $y$ film feed motor and wherein said size dictionary additionally produces a delta $x$ image position control code together with a delta $y$ leading image position control code for each set of the above-mentioned codes;

b. a delta $x$ image position control circuit respnsive to said delta $x$ image position control code for commanding said $x$ motor drive circuit to modify the degree of the movement between characters to maintain proper custom sizing in $x$;

c. a delta $y$ image position control circuit responsive to said delta $y$ leading image position control code for commanding said $y$ motor drive circuit to modify the degree of film feed movement between lines of characters typeset to maintain proper custom sizing in $y$.

11. A phototypesetter comprising:

a. an imaging station;

b. an elongated scanning carriage having optical means thereon for sequentially projecting optical images across said imaging station upon the incremental movement thereof;

c. an elongated driving member;

d. coupling means for coupling said elongated driving member to said elongated carriage;

e. an $x$ positioning stepping motor coupled to said first elongated carriage for incrementally driving said first elongated carriage and thus said elongated driving member;

f. a movable character generating member having character indicia thereon, g. illumination means for sequentially illuminating selected character indicia carried by said character generating member;

h. a first lens carriage having a first lens means coupled thereto for producing images of said characters;

i. a second lens carriage having second lens means coupled thereto for relaying said images to said optical means mounted upon aid scanning carriage;

j. lens carriage positioning means including clutch means for selectively coupling and decoupling said first and second lens carriages to and from said elongated driving member; and k. character generating member actuation means for selectively shifting said character generating member for causing indicia tracks associated therewith to be selectively viewed by said first lens means without changing the conjugate object distance of said first lens means, said character generating member actuation means including clutch means for selectively coupling and decoupling said actuation means to and from said elongated driving member so that a single $x$ positioning motor may be employed for selectively positioning a plurality of lens carriages and said character generating member.

12. The combination as set forth in claim 11 wherein said elongated driving member has a flat surface which is slidable with respect to said lens carriages and said character generator actuating means to provide for selective driving of individual carriages.

13. The combination as set forth in claim 12 wherein said character generating member comprises a radially shiftable rotatable disc bearing character indicia.

14. The combination as set forth in claim 12 wherein said character generating member actuating means comprises a track select carriage coupled to said character generating member together with a track select carriage clutch for coupling and decoupling said track select carriage to and from said elongated driving member.

15. The combination as set forth in claim 11 further including:

a. a $y$ stepping motor for feeding film in a direction traverse to the longitudinal axis of said escapement carriage;

b. a $y$ motor control circuit for stepping said $y$ motor after the completion of a line of characters;

c. delta $x$ image position control means for causing said $x$ positioning stepping motor to modify the degree of escapement movement between characters to command proper custom sizing in $x$ with changes in character sizes; and d. delta $y$ image position control means for causing said $y$ motor to modify the degree of film feed movement between lines of characters typeset, to maintain proper custom sizing in $y$.

16. The combination as set forth in claim 11 wherein said character generating member actuating means comprises a track select carriage coupled to said character generating member together with a track select carriage clutch for coupling and decoupling said track select carriage to and from said elongated driving member.

17. A phototypesetter comprising:

a. an imaging station;

b. an elongated scanning carriage having an imaging lens and an optical scanning element coupled thereto;

c. an elongated driving member;

d. coupling means coupled between said elongated scanning carriage and said elongated driving means;

e. an $x$ position stepping motor for incrementally driving said escapement carriage and thus said elongated driving member;

f. a rotatable character generating disc;

g. flash illumination means for selectively illuminating images of characters upon said disc;

h. a projection lens carriage having a projection lens coupled thereto for producing aerial images of said characters;

i. a collimating lens carriage having a collimating lens coupled thereto for converting said aerial images into collimated light directed at said imaging lens coupled to said scanning carriage;

j. character disc actuation means for radially shifting said character disc for causing selected tracks upon said disc to be viewed by said projection means without changing the conjugate object distance of said projection lens;

k. projection lens carriage clutch means for coupling and decoupling said projection lens carriage to and from said elongated driving member;

l. collimating lens carriage clutch means for coupling and decoupling said collimating lens carriage to and from said elongated driving member;

m. $x$ motor drive control means for causing said $x$ stepping motor to drive said scanning carriage and said elongated driving member;

n. projection lens positioning control means for actuating said projection lens carriage clutch means for mechanically coupling said projection lens carriage to said elongated driving member and for causing said $x$ motor drive control circuit to actuate said $x$ stepping motor to position said projection lens carriage at a position along said optical axis to produce an aerial image of a selected size; and o. collimating lens positioning control means for actuating said collimating lens carriage clutch for coupling said collimating lens carriage to said elongated driving member and for causing said $x$ motor drive control circuit to actuate said $x$ stepping motor to position said collimating lens at a distance from said aerial image to collimate said aerial images so that said aerial images are focused at the imaging plane of said imaging station by said imaging lens regardless of the varying distances between said collimating lens and said imaging lens.

18. The combination as set forth in claim 17 further including:

a. a $y$ stepping motor for feeding film in a direction traverse to the longitudinal axis of said escapement carriage;

b. a $y$ motor control circuit for stepping said $y$ motor after the completion of a line of characters;

c. delta $x$ image position control means for causing said $x$ positioning stepping motor to modify the degree of escapement movement between characters to maintain proper custom sizing in $x$ with changes in character sizes;

d. delta $y$ image position control means for causing said $y$ motor drive circuit to modify the degree of film feed movement between lines of characters typeset to maintain proper custom sizing in $y$.

19. The combination as set forth in claim 18 wherein said elongated driving member has a flat surface which is slidable with respect to said lens carriages and said character generator actuating means to provide for selective driving of individual carriages.

20. The combination as set forth in claim 18 wherein said character generating member comprises a radially shiftable rotatable disc bearing character indicia.

21. The combination as set forth in claim 18 wherein said character generating member actuating means comprises a track select carriage coupled to said character generating member together with a track select carriage clutch for coupling and decoupling said track select carriage to and from said elongated driving member.

22. The combination as set forth in claim 17 wherein said elongated driving member has a flat surface which is slidable with respect to said lens carriages and said character generator actuating means to provide for selective driving of individual carriages.

23. The combination as set forth in claim 17 wherein said character generating member comprises a radially shiftable rotatable disc bearing character indicia.

24. The combination as set forth in claim 17 wherein character generating member actuating means comprises a track select carriage coupled to said character generating member together with a track select carriage clutch for coupling and decoupling said track select carriage to and from said elongated driving member.

25. In a phototypesetter, an improved optical element actuating device comprising:

a. a first movable carriage means having at least one optical element coupled thereto;

b. a second movable carriage means having at least one optical element coupled thereto;

c. an elongated carriage drive member having a flat surface thereon for propelling said first and second movable carriage means;

d. first carriage coupling means for coupling said elongated carriage drive member to said first movable carriage means including at least one flat clutching surface facing said flat surface of said elongated drive member and slidable with respect thereto together with first clutch means associated with said first movable carriage means for selectively coupling and decoupling said flat clutching surface of said first carriage coupling means to and from said flat surface of said elongated drive member;

e. second carriage coupling means for coupling said elongated carriage drive member to said second movable carriage means including at least one flat clutching surface facing said flat surface of said elongated drive member and slidable with respect thereto together with second clutch means associated with said second movable carriage means for selectively coupling and decoupling said flat clutch surface of said second carriage coupling means to and from said flat surface of said elongated drive member;

f. elongated carriage drive member coupling means for actuating said elongated carriage drive member; and g. a drive motor coupled to said elongated carriage drive member coupling means for transmitting force therethrough for actuating said first and second movable carriage means through said elongated carriage drive member upon selective energization of said first and second clutch means.

26. The combination as set forth in claim 25 wherein said flat clutching surfaces of said second movable carriage means comprise terminal portions of an electromagnet.

27. The combiation as set forth in claim 25 wherein said elongated carriage drive member coupling means comprises a force transmitting member for transmitting forces from said scanning carriage to said elongated drive member parallel to the longitudinal axis of said drive member, said force transmitting member furthermore being compliant only in directions transverse to said longitudinal axis of said elongated driving member.

28. The combination as set forth in claim 27 wherein said force transmitting member has a thin elongated wire-like body.

29. The combination as set forth in claim 28 wherein said thin elongated wire-like body has a major dimension of about 1 inch and a minor dimension of about 1/16 inch.

30. The combination as set forth in claim 29 wherein said wire-like body consists of piano wire.

31. The combination as set forth in claim 28 wherein said wire-like body consists of piano wire.

32. The combination as set forth in claim 28 wherein said flat clutching surfaces of said second movable carriage means comprise terminal portions of an electromagnet.

33. In a phototypesetter, an improved optical element actuating device comprising:

a. an imaging station;

b. a scanning carriage having optical means for sequentially projecting focused character images across said imaging station;

c. a first lens carriage means co-acting with the optical means of said scanning carriage;

d. a second leans carriage means, co-acting with said first lens carriage means, which may be positioned independently of said first lens carriage means;

e. an elongated lens carriage drive member having flat clutching surfaces thereon;

f. coupling means for coupling said elongated drive member to said scanning carriage;

g. said lens carriages having flat clutching surfaces facing said flat surfaces of aid elongated drive member;

h. clutch means associated with said first lens carriage means and said second lens carriage means for selectively coupling and decoupling said carriages to and from said flat surfaces of said elongated drive member; and i. a single stepping motor for actuating said scanning carriage and thus said elongated drive member via said coupling means for causing said optical means to scan said imaging plane and for enabling individual actuation of said carriages by activating said clutch means.

34. The combination as set forth in claim 33 wherein said flat clutching surfaces of said lens carriages comprise terminal portions of electromagnets.

35. The combination as set forth in claim 33 wherein said coupling means comprises a force transmitting member for transmitting forces from said scanning carriage to said elongated drive member parallel to the longitudinal axis of said drive member, said force transmitting member furthermore being compliant only in directions transverse to said longitudinal axis of said elongated driving member.

36. The combination as set forth in claim 35 wherein said force transmitting member has a thin elongated wire-like body.

37. The combination as set forth in claim 36 wherein said thin elongated wire-like body has a major dimension of about 1 inch and a minor dimension of about 1/16 inch.

38. The combination as set forth in claim 37 wherein said wire-like body consists of piano wire.

39. The combination as set forth in claim 36 wherein said wire-like body consists of piano wire.

40. The combination as set forth in claim 36 wherein said flat clutching surfaces of said lens carriages comprise terminal portions of electromagnets.

41. In a phototypesetter, an improved optical element actuating device comprising:

a. an imaging station;

b. a scanning carriage having optical means for sequentially projection focused character images across said imaging station;

c. a collimating lens carriage having a collimating lens coupled thereto for directing collimating light at said optical means;

d. a projection lens carriage having a projection lens for producing variable sized aerial images which are collimated by said collimating lens;

e. an elongated lens carriage drive member having flat clutching surfaces thereon;

f. coupling means for coupling said elongated drive member to said scanning carriage;

g. said lens carriages having flat clutching surfaces facing said flat surfaces of said elongated drive member;

h. clutch means associated with said collimating lens carriage and said projection lens carriage for selectively coupling and decoupling said carriages to and from said flat surfaces of said elongated drive member; and i. a single stepping motor for actuating said scanning carriage and thus said elongated drive member via said coupling means for causing said optical means to scan said imaging plane and for enabling actuation of said carriages by activating said clutch means.

42. The combination as set forth in claim 41 wherein said flat clutching surfaces of said lens carriages comprises terminal portions of electromagnets.

43. The combination as set forth in claim 41 wherein said coupling means comprises a force transmitting member for transmitting forces from said scanning carriage to said elongated drive member parallel to the longitudinal axis of said drive member, said force transmitting member furthermore being compliant only in directions transverse to said longitudinal axis of said elongated driving member.

44. The combination as set forth in claim 43 wherein said force transmitting member has a thin elongated wire-like body.

45. The combination as set forth in claim 44 wherein said thin elongated wire-like body has a major dimension of about 1 inch and a minor dimension of about 1/16 inch.

46. The combination as set forth in claim 45 wherein said wire-like body consists of piano wire.

47. The combination as set forth in claim 44 wherein said wire-like body consists of piano wire.

48. The combination as set forth in claim 44 wherein said flat clutching surfaces of said lens carriages comprise terminal portions of electromagnets.

49. A customized method of programming an optical element control system of an individual phototypesetter wherein the optical elements thereof are positioned along an optical axis to produce sharply focused images at an imaging station comprising the steps of:

a. providing a plurality of lens devices for providing character images at said imaging station and which are supported by movable lens carriages having positions along said optical axis which are a function of the sizes of the characters to be phototypeset;

b. positioning said lens carriages in accordance with a set of initial positioning codes along said optical axis at positions which would produce a sharply focused image at said imaging station of said phototypesetter if said lens elements had the theoretically correct focal lengths;

c. examining the resulting images to determine the degree of defocusing due to variations in the theoretically correct focal lengths;

d. altering said initial positioning codes corresponding to the theoretically correct focal lengths stored within said control system by a given incremental amount;

e. re-examining said defocused images and again altering the altered positioning codes if necessary until the images are sharply focused, and thereafter;

f. employing the finally altered positioning codes generated for each character size for positioning said lens carriages in $z$ during subsequent operation of the phototypesetter.

50. The method of claim 49 further including the step of:

a. examining character base line variations in $y$ due to lens parameter variation for each character size imaged upon said imaging station and altering the initial $y$ leading image position codes stored within said control system;

b. repeating step a until the re-examined character base line variations are reduced to satisfactory levels and a finally altered $y$ leading image position codes are produced; and c. employing said finally altered $y$ leading image position codes for controlling character imaging positioning in $y$ during subsequent operation of said phototypesetter.

51. The method of claim 50 further including the steps of:

a. examining side of character placement variations in $x$ due to lens parameter variations for each character size imaged upon said imaging station and altering the initial $x$ image position control codes stored within said control system;

b. repeating step a until the re-examined side of character placement variations are reduced to satisfactory levels and finally altered $x$ position codes are produced; and c. employing said finally altered $x$ image position control codes to control character imaging positioning in $x$ during subsequent operation of the phototypesetter.

52. A customized method of programming an optical element control system of an individual phototypesetter wherein the optical elements thereof are positioned along an optical axis to produce sharply focused images at an imaging station comprising the steps of:

a. providing a plurality of lens devices supported by movable lens carriages having positions along said optical axis controlled by an elongated drive member coupled to a stepping motor capable of moving said elongated drive member in small mechanical increments, at least one of said lens carriages being selectively coupled to said elongated drive member by means of clutches and further including a carriage position command control system for positioning said carriages under the command of positioning command codes stored therein;

b. positioning said lens carriages by virtue of the operation of the system set forth in paragraph a along said optical axis at positions which would produce a sharply focused image at said imaging station of said phototypeseter if said lens devices had the theoretically correct focal lengths;

c. examining the resulting images to determine the degree of defocusing due to variations in the theoretically correct focal lengths of said lens elements;

d. altering the initial positioning codes corresponding to the theoretically correct focal lengths stored within said control system by a given incremental amount;

e. re-examining said defocused images and again altering the altered positioning codes if necessary until the images are sharply focused, and thereafter;

f. employing the finally altered positioning codes for positioning said lens carriages during subsequent operation of the phototypesetter.

53. The method of claim 52 further including the step of:

a. examining character base line variations in $y$ due to lens parameter variation for each character size imaged upon said imaging station and altering the initial $y$ leading image position codes stored within said control system;

b. repeating step a until the re-examined character base line variations are reduced to satisfactory levels and a finally altered $y$ leading image position codes are produced; and c. employing said finally altered $y$ leading image position codes for controlling character imaging positioning in $y$ during subsequent operation of said phototypesetter.

54. The method of claim 53 further including the steps of:

a. examining side of character placement variations in $x$ due to lens parameter variations for each character size imaged upon said imaging station and altering the initial $x$ image position control codes stored within said control system;

b. repeating step a until the re-examined side of character placement variations are reduced to satisfactory levels and finally altered $x$ image position codes are produced; and c. employing said finally altered $x$ image position control codes to control character imaging positioning in $x$ during subsequent operation of the phototypesetter.

55. In a phototypesetter:

a. a character generator for producing images of illuminated characters to be projected along an optical axis upon a photosensitive medium;

b. an $x$ positioning motor;

c. a first carriage coupled to said $x$ positioning motor, for producing relative motion between said medium and said optical axis for sequentially positioning images of said characters to be typeset across said medium;

d. an elongated driving member coupled to said first carriage;

e. at least one additional lens carriage having lens means coupled thereto for producing said images of said characters to be typeset across said medium;

f. carriage clutch means associated with said additional lens carriage(s) for coupling and decoupling said carriage(s) to and from said elongated driving member;

g. $x$ positioning motor drive control means for causing said positioning motor to drive said first carriage together with said elongated driving member; and h. carriage positioning control means for actuating said carriage clutch means for selectively coupling said additional carriage(s) to said elongated driving member and for causing said $x$ motor drive control circuit to actuate said $x$ motor to position said additional carriage(s) at a position along said optical axis to produce an image of a selected size.

56. The combination as set forth in claim 55 wherein said elongated driving member includes a flat clutching surface and wherein said lens carriage(s) have flat clutching surfaces comprising terminal portions of electromagnets.

57. The combination as set forth in claim 56 further including a thin elongated wire-like body for transmitting forces from said first carriage to said elongated driving member parallel to the longitudinal axis thereof, said wire-like body being compliant only in directions transverse to the longitudinal axis of said elongated driving member.

58. The combination as set forth in claim 55 further including a thin elongated wire-like body for transmitting forces from said first carriage to said elongated driving member parallel to the longitudinal axis thereof, said wire-like body being compliant only in directions transverse to the longitudinal axis of said elongated driving member.

59. A customized method of programming an optical element control system of an individual phototypesetter wherein at least one lens device thereof is positioned along an optical axis to produce sharply focused images at an imaging station comprising the steps of:

a. providing at least one focusing lens device for producing character images at said imaging station and which are supported by at least one movable lens carriage having positions along said optical axis which are a function of the sizes of the characters to be phototypeset;

b. positioning said lens carriage(s) in accordance with a set of initial positioning codes along said optical axis at positions which would produce a sharply focused image at said imaging station of said phototypesetter if said lens device(s) had the theoretically correct focal lengths;

c. examining the resulting images to determine the degree of defocusing due to variations in the theoretically correct focal lengths of said lens device(s);

d. altering the initial positioning codes corresponding to the theoretically correct focal lengths stored within said control system by a given incremental amount;

e. re-examining the defocused images and again altering the altered positioning codes if necessary until the images are sharply focused, and thereafter;

f. employing the finally altered positioning codes generated for each character size for positioning said lens carriage(s) in $z$ during subsequent operation of the phototypesetter.

60. The method of claim 59 further including the steps of:

a. examining character base line variations in $y$ due to lens parameter variation for each character size imaged upon said imaging station and altering the initial $y$ leading image position codes stored within said control system;

b. repeating step a until the re-examined character base line variations are reduced to satisfactory levels and finally altered $y$ leading image position codes are produced; and c. employing said finally altered $y$ leading image position codes for controlling character imaging positioning in $y$ during subsequent operation of said phototypesetter.

61. The method of claim 60 further including the steps of:

a. examining side of character placement variations in $x$ due to lens parameter variations for each character size imaged upon said imaging station and altering the initial $x$ image positioning control codes stored within said control system;

b. repeating step a until the re-examined side of character placement variations are reduced to satisfactory levels and finally altered $x$ image position codes are produced; and c. employing said finally altered $x$ image position control codes for controlling character imaging positioning in $x$ during subsequent operation of said phototypesetter.

62. The method of claim 59 further including the steps of:

a. examining side of character placement variations in $x$ due to lens parameter variations for each character size imaged upon said imaging station and altering the initial $x$ image position control codes stored within said control system;

b. repeating step a until the re-examined side of character placement variations are reduced to satisfactory levels and finally altered $x$ image position codes are produced; and c. employing said finally altered $x$ image position control codes to control character imaging positioning in $x$ during subsequent operation of the phototypesetter.

* * * * *